US009314810B2

(12) United States Patent
Uehara

(10) Patent No.: US 9,314,810 B2
(45) Date of Patent: Apr. 19, 2016

(54) APPLICATOR

(75) Inventor: Junya Uehara, Fujioka (JP)

(73) Assignee: MITSUBISHI PENCIL COMPANY, LIMITED, Tokyo (JP)

( * ) Notice: Subject to any disclaimer, the term of this patent is extended or adjusted under 35 U.S.C. 154(b) by 242 days.

(21) Appl. No.: 14/114,261

(22) PCT Filed: Apr. 23, 2012

(86) PCT No.: PCT/JP2012/060857

§ 371 (c)(1),
(2), (4) Date: Oct. 28, 2013

(87) PCT Pub. No.: WO2012/147691

PCT Pub. Date: Nov. 1, 2012

(65) Prior Publication Data

US 2014/0050514 A1 Feb. 20, 2014

(30) Foreign Application Priority Data

Apr. 28, 2011 (JP) ..... 2011-102054

(51) Int. Cl.
*B05C 1/00* (2006.01)
*A45D 34/04* (2006.01)
(Continued)

(52) U.S. Cl.
CPC ..... *B05C 1/00* (2013.01); *A45D 40/262* (2013.01); *A45D 2200/055* (2013.01); *A45D 2200/1072* (2013.01)

(58) Field of Classification Search
CPC ..... B05C 1/00
USPC ..... 401/143, 175, 172, 265, 266, 263
See application file for complete search history.

(56) References Cited

U.S. PATENT DOCUMENTS 8,777,506 B2 * 7/2014 Akaishi et al. ..... 401/266
2005/0063768 A1 3/2005 Tani
(Continued)

FOREIGN PATENT DOCUMENTS

JP 06-60471 U 8/1994
JP 2001-145514 A 5/2001
(Continued)

OTHER PUBLICATIONS

International Search Report (PCT/ISA/210) mailed on May 29, 2012, by the Japanese Patent Office as the International Searching Authority for International Application No. PCT/JP2012/060857.
(Continued)

*Primary Examiner* — Jennifer C Chiang
*Assistant Examiner* — Thomas M Abebe
(74) *Attorney, Agent, or Firm* — Buchanan, Ingersoll & Rooney PC

(57) ABSTRACT

An applicator includes a squeezer for pushing out a content liquid to an applicator part, and the shape of a content liquid delivering port of the applicator part is formed to be oval or rectangular while the minor axis and major axis on the delivery port side are specified to be 0.5 to 2 mm and 2 to 8 mm, respectively. In this applicator, large-sized particles can be delivered by enlargement of the bore inside the applicator part. Further, formation of an oval delivering port allows for drawing fine lines in the minor axis direction and thick lines in the major axis direction. Moreover, provision of small-diametric projections at the front end of applicator, enables drawing of long lines and retaining of the liquid cosmetic stored between projections.

6 Claims, 14 Drawing Sheets

(51) Int. Cl.
*A46B 11/02* (2006.01)
*A45D 40/26* (2006.01)

(56) References Cited

U.S. PATENT DOCUMENTS

2007/0020038 A1* 1/2007 Tani ..... 401/265
2007/0227553 A1 10/2007 Gueret

FOREIGN PATENT DOCUMENTS

JP 2001145514 A * 5/2001
JP 2002-254018 A 9/2002
JP 2004-154173 A 6/2004
JP 2005-087562 A 4/2005
JP 2005-118367 A 5/2005
JP 2007-000272 A 1/2007

OTHER PUBLICATIONS

Notification of Transmittal of Translation of the International Preliminary Report on Patentability (Chapter I or Chapter II)(PCT/IB/338) and International Preliminary Report on Patentability (Form PCT/IB/373) and Written Opinion of the International Searching Authority for International (Translation)(Form PCT/ISA/237) issued on Nov. 7, 2013, in corresponding International Application No. PCT/JP2012/060857. (6 pages).
Extended Search report issued in corresponding European application on Sep. 4, 2014 (3 pages).

* cited by examiner

APPLICATOR

TECHNICAL FIELD

The present invention relates to an applicator used for cosmetics, stationery, daily life commodities and others, such as ink for writing implements and liquid cosmetics.

BACKGROUND ART

Conventionally, applicators comprised of a brush, a pen core and resin molding parts have been known.

Of these applicators, there are known ones which include a liquid delivering mechanism that delivers a liquid sent out mechanically (by knocking or thrusting) from a liquid reservoir of the main body by way of a communication pipe connected to the reservoir, to an applicator part connected with the communication pipe. Further, a brush-type applicator has a brush of a tapering (conical) shape, composed of multiple bundles of fiber to perform drawing and application, which provides a supple feature for actions of the writing tip.

However, the brush-type applicator is formed with an aggregate of fiber, or a lump of multiple fibers, so that, in particular, lame particles of large sizes are prone to clog between fibers in the way of delivery due to friction with the fibers, possibly causing ejection failure in some cases. Further, though the brush type needs to have a hole formed in the approximate center in the course of shaping in order to secure a liquid flow passage, lame particles etc., are prone to build up in that space. There have been also problems such that the in-pipe resistance against the thrusting force of liquid is strong, giving rise to the cause of clogging.

To deal with this, there are various known applicators having an applicator part formed with brushy tip and a secured liquid passage.

For example, (1) in order to provide a fluid cosmetic applicator that enables application of a fluid cosmetic in dyeing eye brows etc., easily and uniformly without soiling the skin, the fluid cosmetic applicator includes an applicator part having, at least, two or more comb tooth parts at the front end of the applicator body in which a fluid cosmetic is stored, and is characterized in that the comb-tooth parts are configured so that the comb-tooth pitch P between comb-tooth parts is 0.2 to 1.0 mm and that the depth L of the comb-tooth part is 2 to 8 times of the comb-tooth pitch and the shape of the delivery port of the applicator part is circular (e.g., see Patent Document 1). (2) In order to provide a hair-care cosmetic applicator that enables application of a hair-care cosmetic without unevenness by keeping the amount of ejection uniform, the hair-care cosmetic applicator includes a container body holding a hair-care cosmetic therein and a lid body fitted on the container body, and is constructed such that the lid body has a nozzle member formed of a pair of wall parts extended to the front and a pair of side-wall parts connecting the both ends of the wall parts, a plurality of comb-teeth are arranged in, at least, one distal end of the wall parts, and the hair-care cosmetic stored in the container body is ejected from delivery ports formed in the nozzle member via a communication passage bored inside the nozzle member (e.g., see Patent Document 2). (3) Known is a liquid applicator having an elongate liquid delivery port for applying a liquid such as mascara, which is constructed such that, in order to prevent uneven application by ejecting the liquid approximately uniformly from every position across the liquid delivery port, the elongate liquid delivery port is formed with a liquid distribution passage that enlarges the width of the liquid flow passage on the downstream of the liquid feed path, and the liquid distribution passage is formed to be approximately line-symmetrical about the normal line perpendicular to the application surface at the center of the liquid delivery port while brushes are projectively formed on both sides of the liquid delivery port (e.g., see Patent Document 3).

Another known applicator is (4) an applicator including: a container body that is configured to be able to push out a fluid content stored in a reservoir therein, toward the front side; a core member attached to the front end of the container body and formed with a bore that is connected to the reservoir and extends to the front end side along the axis; an applicator member formed of a soft resilient material, attached immovably in the axial direction so as to cover the front end side of the core member, and having an open delivery port on the front end face, wherein an interior space is formed between the front end side of the core member and the applicator member, the applicator member is formed with a delivering bore that connects between the delivery port and the interior space, the core member has a communication hole that establishes communication with a projected part that projects from its front end towards the delivering bore of the applicator member, the projected part of the core member is arranged so that its external surface comes close to, or abuts, the delivering bore so as to prevent the fluid content from leaking and has a large number of projections having a brushing function (e.g., see Patent Document 4). Also known is (5) a cosmetic applicator having an applicator member at the front end, a cosmetic container storing a fluid cosmetic such as mascara in the rear end thereof, and a pumping type pressurizing mechanism in the rear of the cosmetic, in which the applicator member is formed with a bore that feeds the cosmetic in the axial center thereof, a delivery opening that communicates with the bore, arranged at a necessary position on the external surface of the barrel and a brush or comb-toothed projected pieces for application arranged near the delivery opening, and an elastic body forming a porous fine continuous passage is arranged between the applicator member and the delivery opening, the continuous passage being sealed in the normal condition (e.g., see Patent Document 5).

However, the above Patent Documents 1, 3 and 5 disclose applicators for dyeing hair such as eyebrows, whereas the above Patent Documents 2 and 4 disclose cosmetic applicators for hair care. That is, these applicators cannot be used for drawing fine lines such as eyeliner, and entails a problem of clogging in the application pipe when an application liquid containing large particles is applied. Further, in the applicator of the above Patent Document 3, since a zigzag liquid feed path is formed, an application liquid containing large-sized particles, in some cases, cannot flow efficiently. The applicator of the above Patent Document 5 entails the problem that the existence of the core member impedes the flow path and causes clogging.

PRIOR ART DOCUMENTS

Patent Documents

Patent Document 1: Japanese Patent Application Laid-open 2004-154173 (Claims, FIG. 1 and others)

Patent Document 2: Japanese Patent Application Laid-open 2001-145514 (Claims, FIG. 11, FIG. 8, and others)

Patent Document 3: Japanese Utility Application Laid-open H06-60471 (Utility Claims, FIG. 1, FIG. 2, and others)

Patent Document 4: Japanese Patent Application Laid-open 2005-87562 (Claims, FIG. 1, FIG. 2, FIG. 16, and others)

Patent Document 5: Japanese Patent Application Laid-open 2005-118367 (Claims, FIG. 1, and others)

SUMMARY OF THE INVENTION

Problems to be Solved by the Invention

In view of the problems of the prior art and the status quo, the present invention is aimed at solving the above problems and to provide an applicator, which enables the user to draw fine lines such as eyeliner and is free from clogging inside the application pipe even if the application liquid containing large particles is applied, and can satisfy the user.

Means for Solving the Problems

The inventors hereof have earnestly studies on the above prior art problems and resultantly found out that an applicator including: an applicator part having a mechanism for delivering or applying a content liquid; a reservoir filled with the content liquid; and an extruder having a mechanism for thrusting the content liquid to the applicator part, and further comprising a flow passage connecting between the applicator part and the reservoir so that the content liquid in the reservoir is delivered from the applicator part as being pushed out by the extruder and passing through the flow passage connecting between the reservoir and the applicator part, can achieve the above object, by configuring the content liquid delivery port of the applicator part in a specific shape and structure, and completed the present invention.

That is, the present invention resides in the following (1) to (5).

(1) An applicator includes; an applicator part having a mechanism for delivering or applying a content liquid; a reservoir filled with the content liquid; and an extruder having a mechanism of pushing out the content liquid to the applicator part, and wherein a flow passage that connects between the applicator part and the reservoir is formed, thereby pushing out the content liquid inside the reservoir, and the content liquid passes through the flow passage communicating between the applicator part and the reservoir, thereby being ejected out from the applicator part, and wherein the shape of the content liquid delivery port of the applicator part is oval or rectangular, and the minor axis and major axis on the delivery port side are specified to be 0.5 to 2 mm and 2 to 8 mm, respectively.

(2) The applicator defined in the above (1), wherein a plurality of small-diametric projections are formed on the delivery port side of the applicator part, being 0.1 to 1 mm in outside diameter and 0.5 to 3 mm long with a pitch of 0.1 to 1.5 mm.

(3) The applicator defined in the above (2), wherein the tip of the small-diametric projection arranged on the delivery port side of the applicator part flexes 1 mm when a force of 0.001 to 0.5 N is applied in a direction at right angles thereto.

(4) The applicator defined in any one of the above (1) to (3), wherein the applicator part is formed of a soft plastic material of rubber or elastomer.

(5) The applicator defined in any one of the above (1) to (4), wherein the content liquid is a liquid cosmetic that has a viscosity (25 deg. C.) at a shear rate of 76.8 $S^{-1}$ in an EMD type viscometer, falling within the range of 250 to 1,000 mPa·s.

Effect of the Invention

According to the present invention, even if the content liquid such as a cosmetic containing large-sized particles is applied, provision of small-diametric projections on the delivery port enables the user to apply fine lines in the minor axis direction and thick lines in the major axis direction, thus making it possible to provide an applicator that can satisfy the user.

According to the invention of claim 2, it is possible to provide an applicator that can more satisfy the user.

According to the present invention of claim 3, impartment of moderate flexibility to the small-diametric projections arranged on the delivery port makes it possible for the user to perform application with an application force suitable for skin contact without feeling pain.

According to the invention of the claim 4, it is possible to provide an applicator that can produce suitable rigidity for makeup actions by means of the whole applicator part.

According to the invention of claim 5, since the content liquid such as a liquid cosmetic can be retained between small-diametric projections provided at the front end of the applicator part, further satisfiable application can be achieved.

MODE FOR CARRYING OUT THE INVENTION

Now, the embodiment of the present invention will be detailed with reference to the drawings.

Figure 1A:
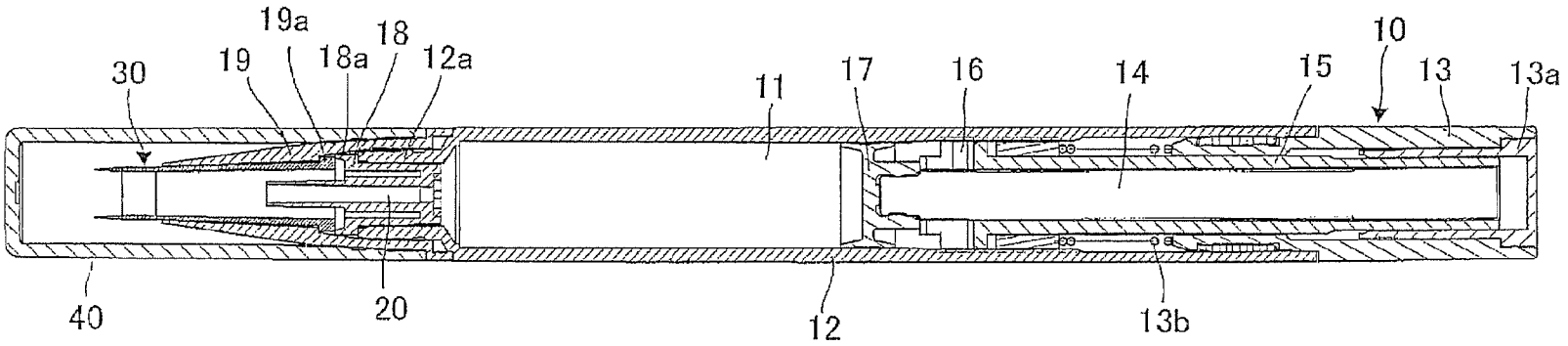
FIG. 1 is an illustrative diagram showing overall sections of an applicator according to the first embodiment of the present invention, (a) a plan sectional view and (b) a front sectional view.
Figure 1B:
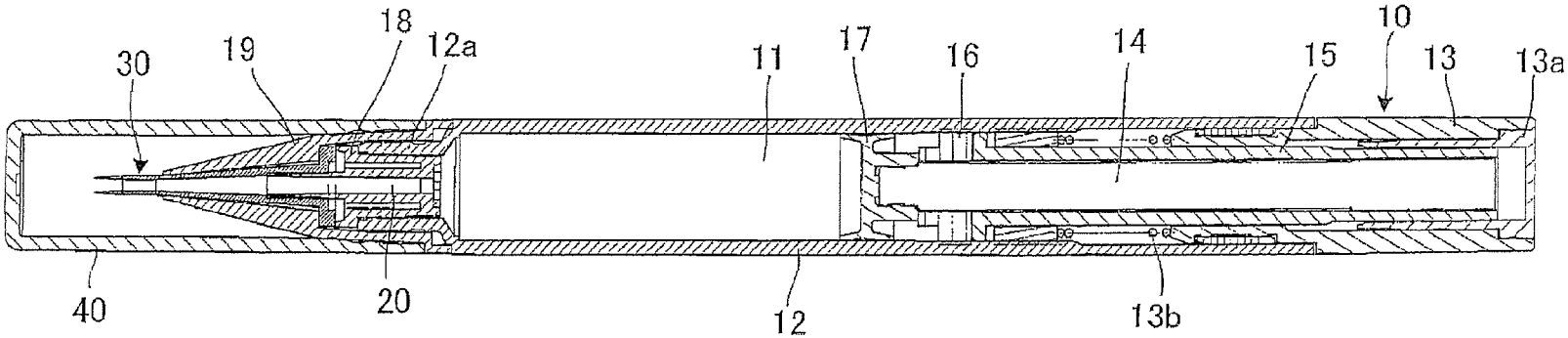
Figure 2A:
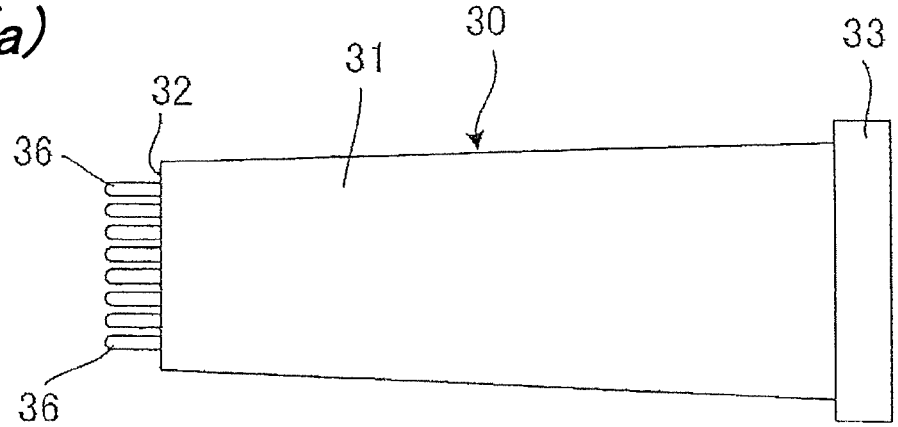
FIG. 2 is an illustrative diagram of an applicator part in the applicator of FIG. 1, (a) a plan view, (b) a front view, (c) a front sectional view and (d) a plan sectional view.
Figure 2B:
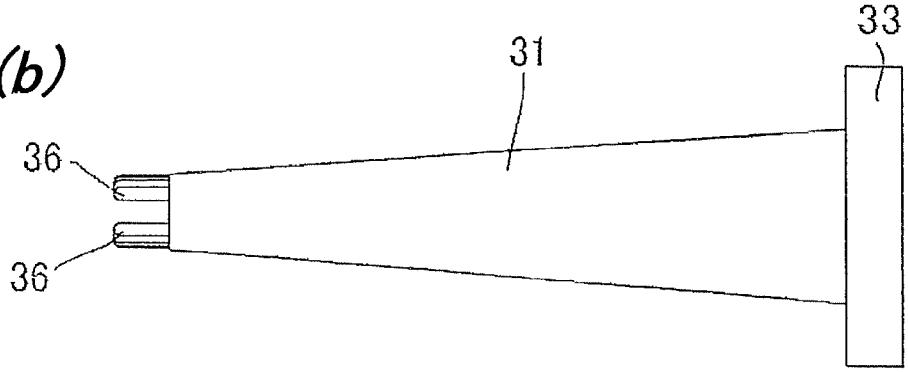
Figure 2C:
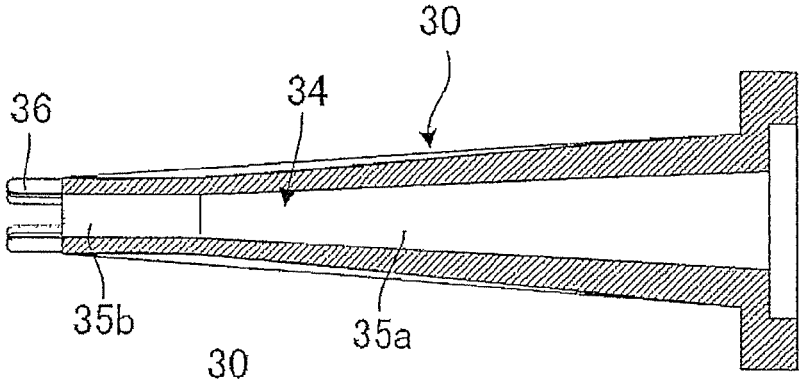
Figure 2D:
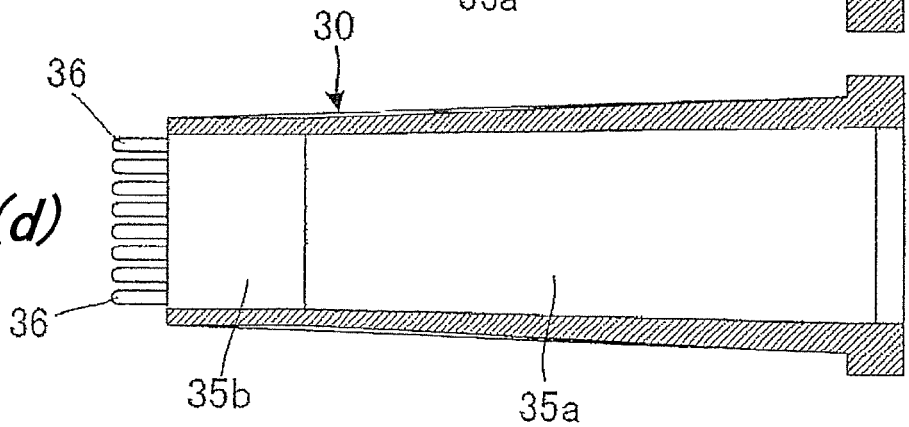

The applicator according to the first embodiment of the present invention is an applicator using an extruder of a twist-up dispensing type for a liquid thrusting mechanism, and includes: as shown in FIG. 1, an applicator part 30 having a mechanism for delivering or applying a content liquid (which is a "liquid cosmetic" in this embodiment, and so forth); a reservoir 11 filled with the content liquid; and an extruder 10 having a mechanism of pushing out the content liquid to applicator part 30. A flow passage 20 that connects between the applicator part 30 and reservoir 11 is formed, thereby pushing out the content liquid inside the reservoir 11 by means of extruder 10, the content liquid is delivered from applicator part 30 as passing through the flow passage 20 communicating between applicator part 30 and reservoir 11.

Extruder 10 is configured to feed and dispense the content liquid in container (reservoir) 11 to applicator part 30 by rotating an advancing member 13 arranged at the rear end of a barrel body 12, in a circumferential direction relative to barrel body 12.

This extruder 10 of the applicator includes the advancing member 13 rotatably fitted with the rear end of barrel body 12, a drive sleeve 15 transmitting user's rotational force on advancing member 13 to a screw rod 14, a threaded part 16 fixed to barrel body 12 and mating with screw rod 14, the screw rod 14 having a piston body 17 rotatably engaged at the front end thereof, and the piston body 17 that slides inside reservoir 11 of barrel body 12. Rotation of advancing member 13 is transmitted to screw rod 14 by means of the drive sleeve 15. As this screw rod 14 rotates, the screw rod 14 and piston body 17 move forwards by the means of the female thread of nut-like threaded part 16 to deliver the content liquid from reservoir 11 to applicator part 30.

As shown in FIG. 1, advancing member 13 is a cylindrical actuator which is closed with a crown 13*a* fitted in at the rear end thereof and is rotatably fitted and partly exposed in the rear end part of barrel body 12. Drive sleeve 15 is fitted inside advancing member 13 and fixed with respect to the rotational direction. Threaded part 16 is attached inside this drive sleeve 15 so as to be fixed in the rotational direction and relatively movable with respect to the axial direction (the threaded part does not move). Designated at 13*b* is a spring member, which urges advancing member 13 to be a rotary part rearwards (which urges a part called cam piece located under arrow 10 in FIG. 1 in the front direction).

In this applicator, a joint member 18, a front barrel 19 and applicator part 30 are assembled by push-in to the front end part designated at 12*a* of barrel body 12. Reservoir 11 of barrel body 12 stores the content liquid. The content liquid delivered from the reservoir 11 passes through flow passage 20 inside joint member 18 and is ejected to applicator part 30 so as to be applicable. Further, front barrel 19 is formed so that a cap 40 can be attached thereto (fitted thereon) to cover applicator part 30 and front barrel 19 after use.

Figure 3A:
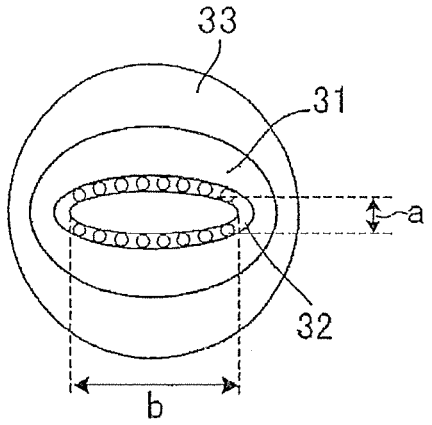
FIG. 3 is an illustrative diagram of an applicator part in the applicator of FIG. 1, (a) a left side view, (b) a right side view, and (c) a perspective view.
Figure 3B:
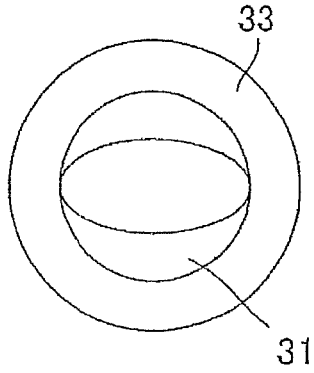
Figure 3C:
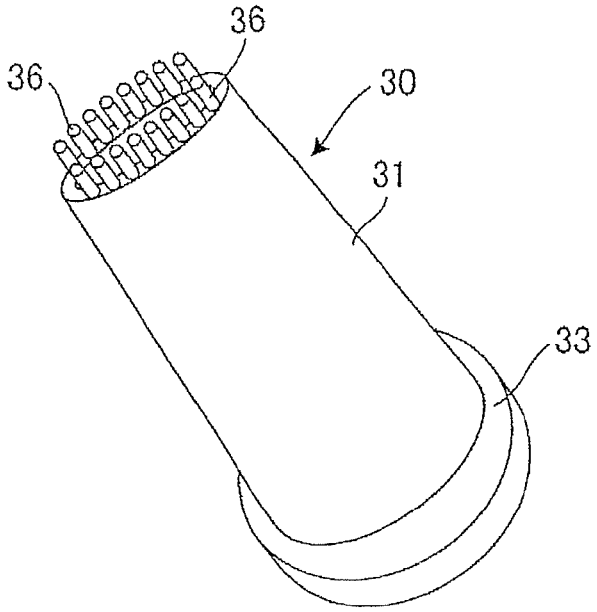
Figure 4A:
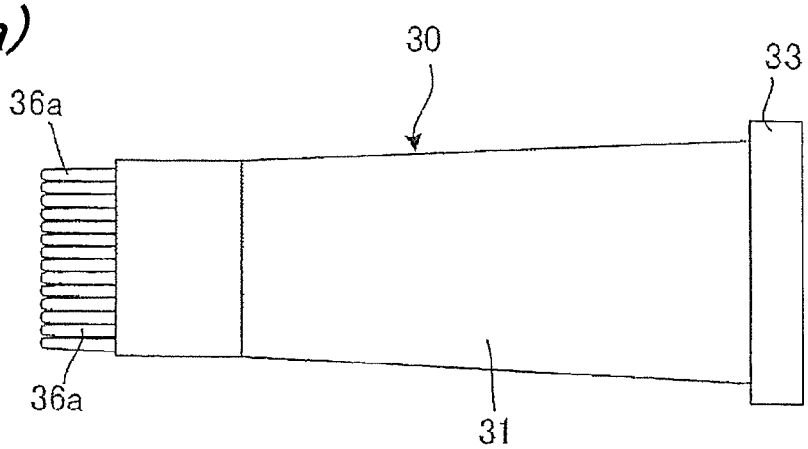
FIG. 4 is an illustrative diagram of an applicator part in an applicator according to the second embodiment of the present invention, (a) a plan view, (b) a front view, (c) a front sectional view, and (d) a plan sectional view.
Figure 4B:
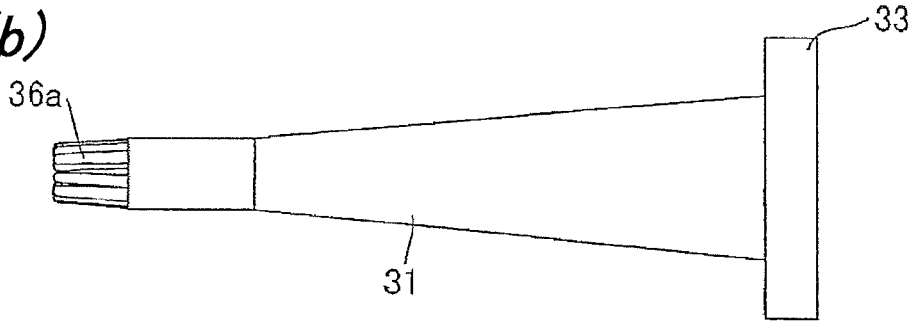
Figure 4C:
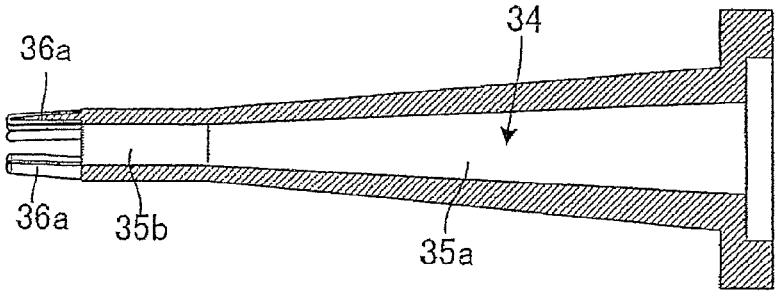
Figure 4D:
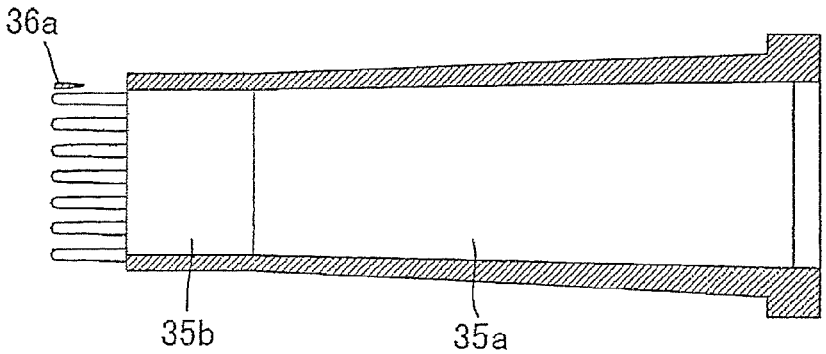

Applicator part 30 in the applicator of the present invention has an overall tapering shape from the rear to the front, as shown in FIGS. 2 and 3 and is formed of a content liquid delivery port 32 on the front side and a flange part 33 on the rear side of an applicator part body 31.

Applicator part body 31 has an oval cross section and is formed with a liquid flow pass 34 therein, which communicates with flow passage 20. This liquid pass 34 is formed of a tapering pass 35*a* that is reduced in diameter toward the front and a tubular pass 35*b* having a constant cross section.

In view of achieving good delivery performance and application performance, content liquid delivery port 32 on the front opening side of applicator part body 31 is oval while the external shape of flange part 33 located on the rear side is circular.

Formation of an oval or rectangular (which will be described later) delivery opening to be the opening of delivery port 32 is aimed at allowing for application of different kinds of application lines, i.e., thick and thin lines. As to the dimensions, or the minor axis 'a' is specified to be 0.5 to 2 mm and the major axis 'b' to be 2 to 8 mm, as shown in FIG. 3(*a*). Preferably, the minor axis 'a' is specified to be 0.8 to 1.0 mm and the major axis 'b' to be 3 to 5 mm. Here, it is desired that the minor axis 'a' and the major axis 'b' are not equal to each other ($a \neq b$). For example, it is preferable that the shape of the opening is not circular or square. Since the dimension of minor axis 'a' and the dimension of major axis 'b' are defined, the rectangular shape can be formed in a shape other than four angles.

A plurality of small-diametric projections 36, 36, . . . are formed around the delivery opening on the delivery port 32 side. Though the size of each small-diametric projection 36 may be varied depending on the target to be applied, usability, the type of content liquid and others, in view of the delivery performance of large-sized particles such as lame particles and drawing fine application lines, it is preferable to specify that the outside diameter is 0.1 to 1 mm, the length is 0.5 to 3 mm, and the pitch between small-diametric projections is 0.1 to 1.5 mm.

More preferably, the outside diameter is 0.3 to 0.5 mm, the length is 0.5 to 1.0 mm and the pitch between small-diametric projections is 0.2 to 0.4 mm. In the present embodiment, sixteen small-diametric projections 36 are provided.

Further, it is preferable that the tip of small-diametric projection 36 arranged on the delivery port 32 side of the applicator part 30 flexes 1 mm when a force of 0.001 to 0.5 N is applied in a direction at right angles to the tip. The requirement that the tip of small-diametric projection of the applicator flex 1 mm when a force of 0.001 to 0.5 N is applied in a direction at right angles, is achieved by using a measuring method (including the examples described later) in which the applicator and a force gauge (LV500N, a product of IMADA-SS Corporation) are mounted on a base so as to measure the load at the position where the tip of applicator part is flexed 1 mm from its contact point.

Impartment of moderate flexibility of the above requirement to small-diametric projections 36 arranged on this delivery port 32 makes it possible for the user to apply the liquid with an application force suitable for skin contact without feeling pain.

The thus configured applicator part 30 may be integrally formed using a material such as rubber, plastic, and elastomer. In view of imparting optimal rigidity for makeup actions to the whole applicator part, it is preferable that the applicator part is integrally formed of a soft plastic material, for example, rubber such as NBR, silicone rubber, EPDM, fluoro silicone rubber, fluoro rubber, urethane rubber, natural rubber, chloroprene rubber, butadiene rubber, butyl rubber, and silicone rubber, or elastomer such as styrene elastomer, vinyl chloride elastomer, olefin elastomer, polyester elastomer, polyamide elastomer, urethane elastomer, and silicone elastomer. In view of imparting the most suitable rigidity for makeup actions, styrene elastomer is especially preferable to use for integral molding.

Applicator part 30 of this configuration is fitted into front barrel 19 and fixed with rear flange part 33 held between a rear step 19*a* of front barrel 19 and front end part 18*a* of joint member 18.

As the content liquid stored in reservoir 11 of the applicator of the present invention, various kinds of content liquids may be used depending on the mode of the applicator. Other than liquid cosmetics, liquids such as ink for writing implements may be used and the composition and others of the liquid should not be particularly limited.

In view of sedimentation of coloring materials and presenting good application performance, the liquid cosmetic has a viscosity (25 deg. C.) at a shear rate of 76.8 $S^{-1}$ in an EMD type viscometer preferably falling within the range of 250 to 1,000 mPa·s, or more preferably falling within the range of 280 to 900 mPa·s, and the liquid cosmetic further preferably comprises 1 to 20 mass % of high-brightness particles, 2 to 10 mass % of film-forming resin, 0.3 to 2 mass % of an anionic polymer compound having a thickening effect, and water.

The high-brightness particles being used are not particularly limited, and any stuff can be used as long as it is usually used for cosmetics. For example, at least, one kind, selected from mica-titanium, metal-coated mica-titanium, metal-coated glass powder, metal oxide-coated glass powder, metal oxide-coated synthetic phlogopite, argentine, bismuth oxychloride, polyethylene terephthalate.aluminum.epoxy laminate powder, polyethylene terephthalate.polyolefin laminate film powder, and polyethylene terephthalate.polymethylmethacrylate laminate film powder, can be used.

The particle size of the high-brightness particles being used is preferably 50 to 500 μm or more preferably 150 to 300 μm. Here, "particle size" in the present invention (inclusive of examples) is a value determined based on the mean particle diameter of measurement results by observing arbitrary particles of n=20 or greater with a microscope.

The content of these high-brightness particles is preferably 1 to 20 mass % (which will be merely referred to hereinbelow as "%") or more preferably 2 to 10% relative to the total amount of the liquid cosmetic.

Other than the high-brightness particles, one of coloring materials including inorganic pigments such as black iron oxides, yellow iron oxides, chromium oxide, lapis lazuri, Prussian blue, zinc oxide, aluminum oxide, silicon dioxide, titanium oxide, magnesium oxide, chromium hydroxide, calcium carbonate, magnesium carbonate, Titan yellow, and Indian red, organic pigments, various dyes and carbon black, may be used in combination.

As examples of the anionic polymer compound having a thickening effect being used, one or two kinds selected from methylvinyl ether/maleic acid crosspolymer, acrylates/C10-30 alkyl acrylate crosspolymer, and acrylic acid/vinylpyrrolidone crosspolymer are preferably used. As the products on the market, the "STABILEZE" series (products of ISP (Japan) Ltd.) and the "Carbopol" series (products of BF Goodrich Co.) can be mentioned.

The content of the anionic polymer compounds having thickening effect is preferably 0.3 to 2%, more preferably 0.4 to 1%, relative to the total amount of the liquid cosmetic.

As the film-forming resin used in the present invention, homopolymer or copolymer, made up of one or more kinds of compounds selected from acrylic acid, methacrylic acid or C1-4 and C8 alkyl ester of these acids, is used. Preferably, the homopolymer or copolymer is acrylic resin or alkyl acrylate copolymer having acidic residues as side chains in its repeated structure and can dissolve into water by neutralization. As products on the market, Luvimer 100P (a product of BASF Co.,) can be mentioned.

The content of these film-forming resins is preferably 2 to 10%, more preferably 3 to 6%, relative to the total amount of the liquid cosmetic.

The liquid cosmetic being used may further include additives that are usually used for water-based liquid makeup cosmetics, such as chelating agents, pH adjustors, moisturizing agents, thickening agents, and preservatives, the remaining part being adjusted with water such as purified water and deionized water.

As more preferable ranges of viscosity, it is preferable that the viscosity falls within the range of 2,500 to 10,000 mPa·s at a shear rate of 3.83 $s^{-1}$, within the range of 1,000 to 3,000 mPa·s at 19.20 $s^{-1}$ and within the range of 500 to 1500 mPa·s at 38.3 $s^{-1}$. Adjustment of the viscosity within the above range can be achieved by specifying appropriate combination of the contents of the high-brightness particles, film-forming resin, anionic polymer compound having a thickening effect and water, and by adding a thickening agent and others.

The thus configured applicator of the present embodiment operates such that the content liquid pushed out from reservoir 11 by extruder 10 passes through flow passage 20 inside joint member 18 and enters into liquid flow pass 34 of applicator part 30 to be ejected from the opening of delivery port 32 of applicator part 30. Then, the content liquid is retained in the gaps between small-diametric projections 36 by the function of capillary force, so that the liquid can be applied on a target application surface by placing the tips of small-diametric projections 36. In this mode, enlargement of the inside diameter of the applicator part enables ejection of large-sized particles, formation of the opening in an oval shape allows to draw fine lines by use of the minor axis direction and thick lines by use of the major axis direction, and provision of small-diametric projections at the front end of the applicator part enables drawing of long lines and retaining of the liquid stored between the projections, whereby the small-diametric projections allow the user to apply fine lines in the minor axis direction and thick lines in the major axis direction, thus making it possible to draw application lines that can satisfy the user.

Further, the outside diameter, length, pitch and number of small-diametric projections 36 may be adjusted as appropriate so that it is possible to desirably control the amount of content liquid to be retained, the distance of application, the amount of application, the width of application, and others.

Further, as shown in FIG. 1, the passage from the liquid storage or reservoir 11 to the front end of the delivery port is approximately directly connected and formed of a linear pipe, so that the resistance against the content liquid is contributed to only the pipe friction on the inner diameter surface, which is free from resistance resulting from fibers like a brush type. Accordingly, this configuration is effective against clogging, so that it is possible to exhibit good delivery performance even for high-brightness particles such as lame having a particle size of 700 μm.

The applicator of the present invention should not be limited to the above embodiment, but various changes can be made without departing from the sprit and scope of the present invention.

The applicator of the present invention is characterized by the shape and structure of applicator part 30, so that other architecture may be adopted as appropriate for those other than the configuration of the applicator part.

In the above embodiment, small-diametric projections 36 provided on delivery port 32 are planted upright. However, the small-diametric projections 36 may be planted with various inclinations as shown in FIGS. 4 to 11 so as to create variations in application performance and application lines. In FIG. 4 and the following figures, the same components as in FIGS. 1 to 3 are allotted with the same reference numerals without description.

Figure 5A:
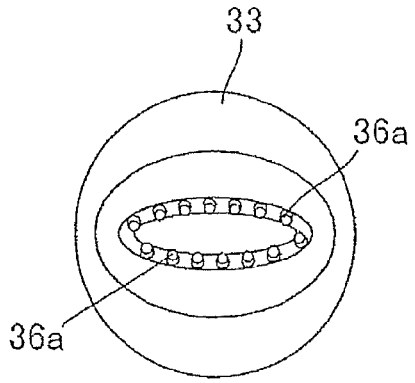
FIG. 5 is an illustrative diagram of the applicator part of FIG. 4, (a) a left side view, (b) a right side view, and (c) a perspective view.
Figure 5B:
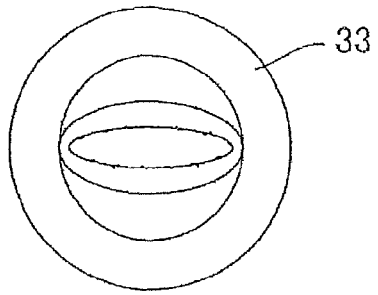
Figure 5C:
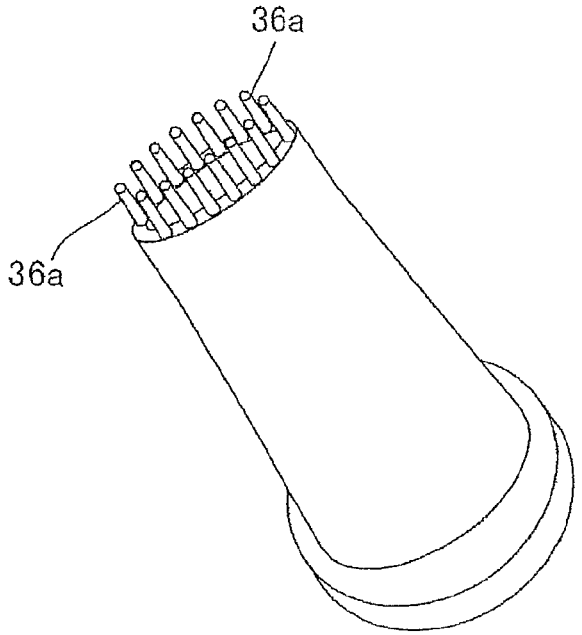
Figure 6A:
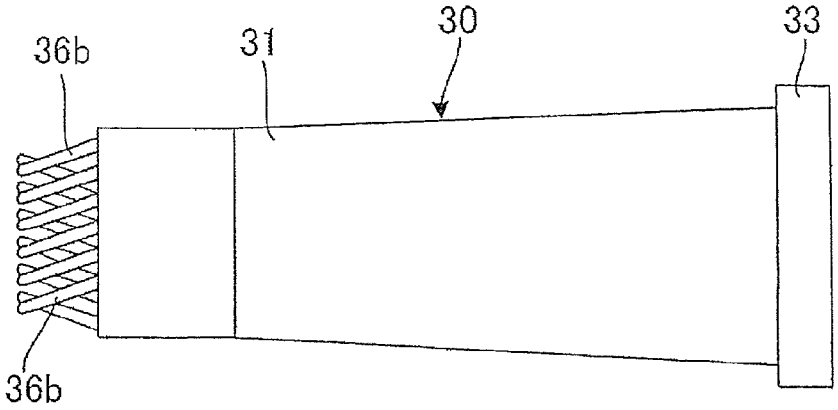
FIG. 6 is an illustrative diagram of an applicator part in an applicator according to the third embodiment of the present invention, (a) a plan view, (b) a front view, (c) a front sectional view, and (d) a plan sectional view.
Figure 6B:
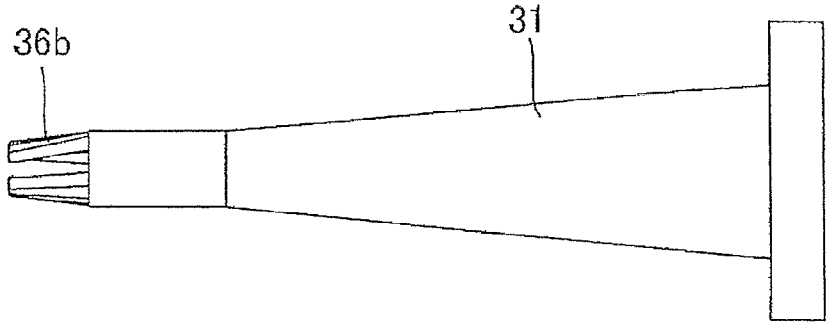
Figure 6C:
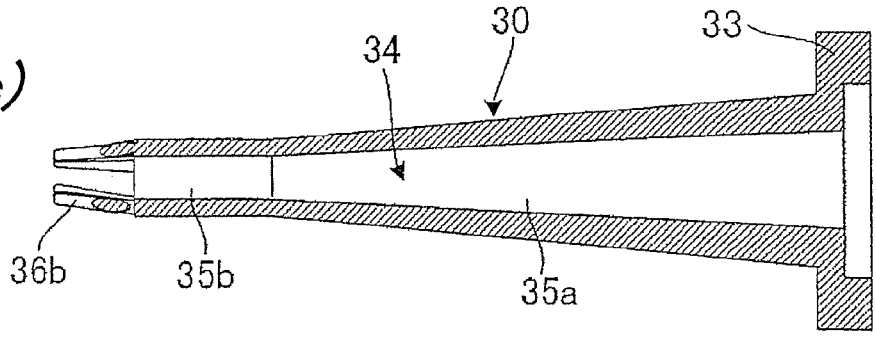
Figure 6D:
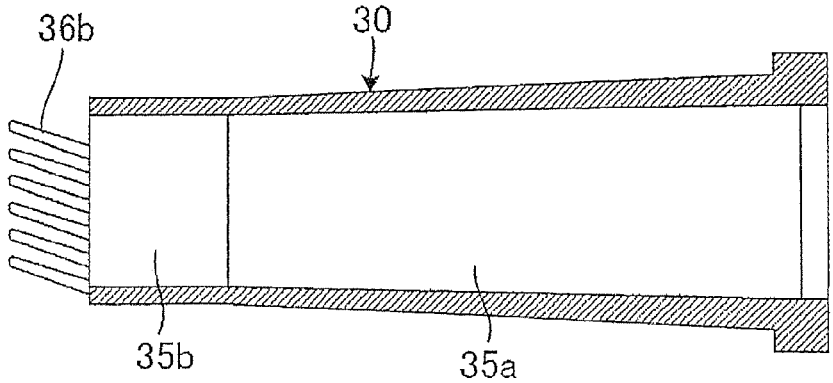

FIGS. 4 and 5 show an applicator part of the second embodiment, wherein small-diametric projections of applicator part 30 are tilted toward the axial center, forming small-diametric projections 36*a*, compared with the first embodiment.

Figure 7A:
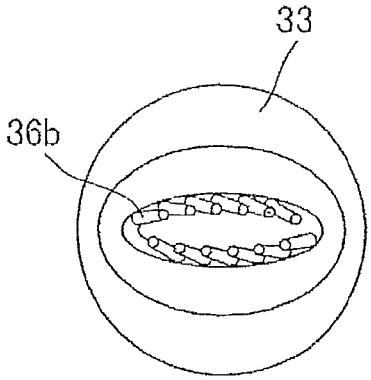
FIG. 7 is an illustrative diagram of the applicator part of FIG. 6, (a) a left side view, (b) a right side view, and (c) a perspective view.
Figure 7B:
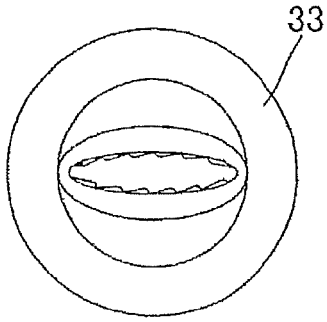
Figure 7C:
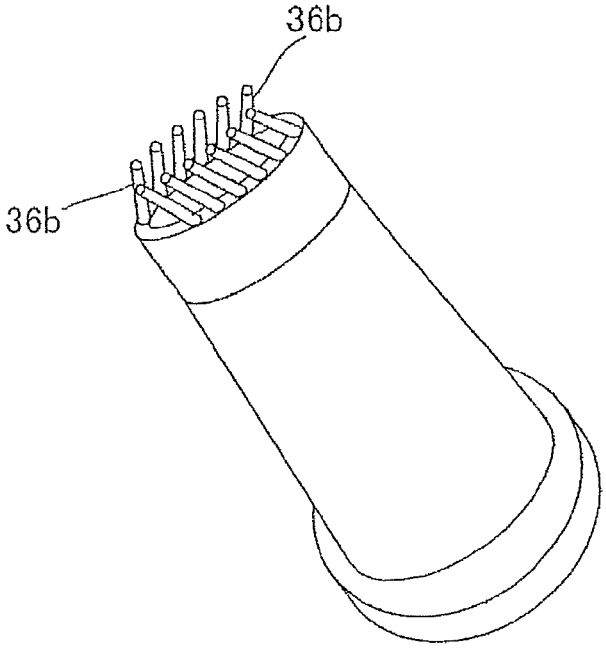
Figure 8A:
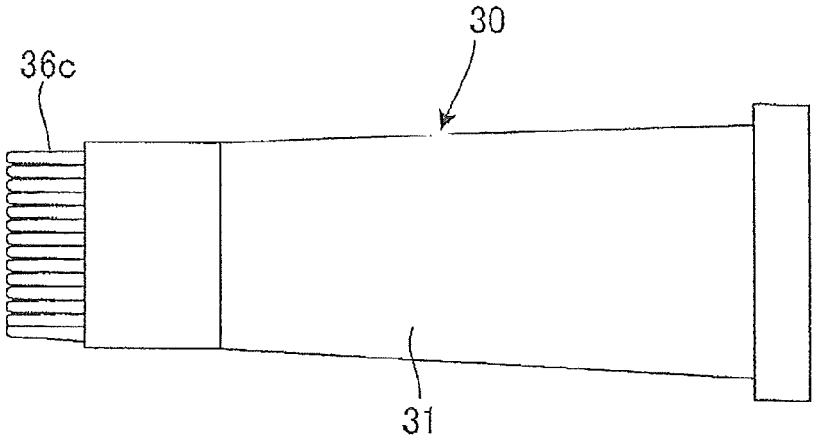
FIG. 8 is an illustrative diagram of an applicator part in an applicator according to the fourth embodiment of the present invention, (a) a plan view, (b) a front view, (c) a front sectional view, and (d) a plan sectional view.
Figure 8B:
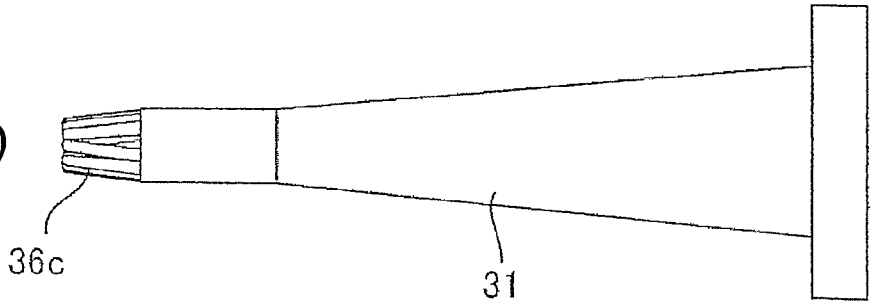
Figure 8C:
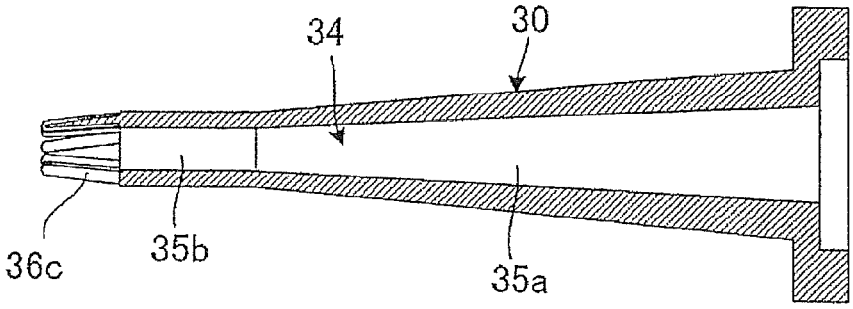
Figure 8D:
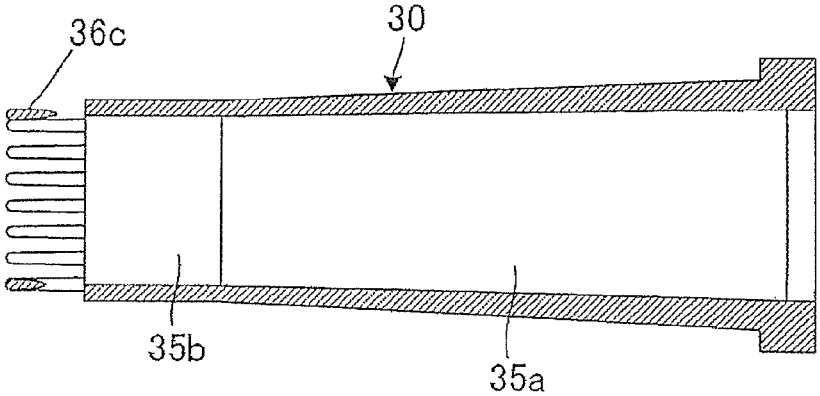

FIGS. 6 and 7 show an applicator part of the third embodiment, wherein small-diametric projections of the applicator part are tilted in a fixed direction, forming small-diametric projections 36*b*, compared with the first embodiment.

Figure 9A:
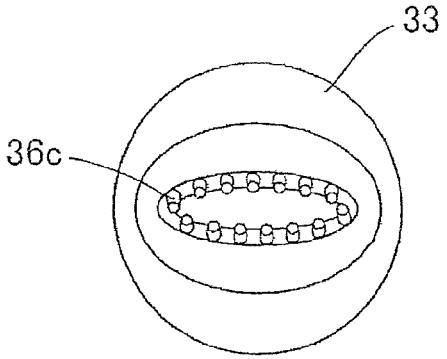
FIG. 9 is an illustrative diagram of the applicator part of FIG. 8, (a) a left side view, (b) a right side view, and (c) a perspective view.
Figure 9B:
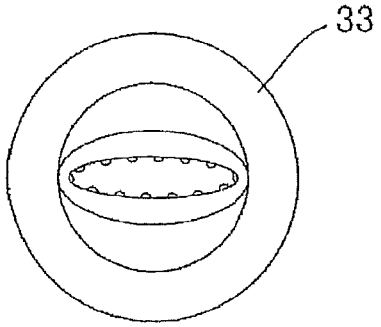
Figure 9C:
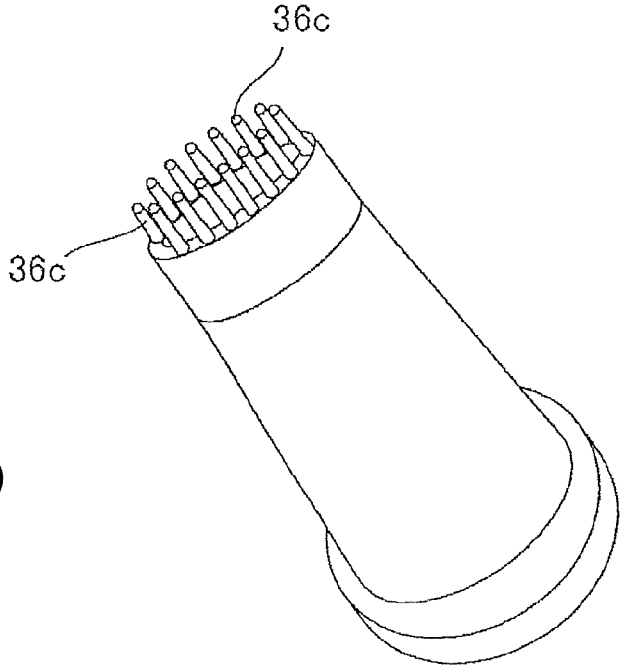
Figure 10A:
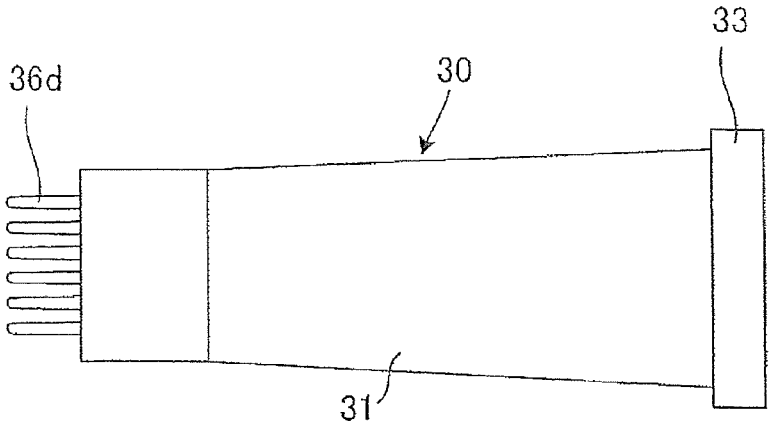
FIG. 10 is an illustrative diagram of an applicator part in an applicator according to the fifth embodiment of the present invention, (a) a plan view, (b) a front view, (c) a front sectional view, and (d) a plan sectional view.
Figure 10B:
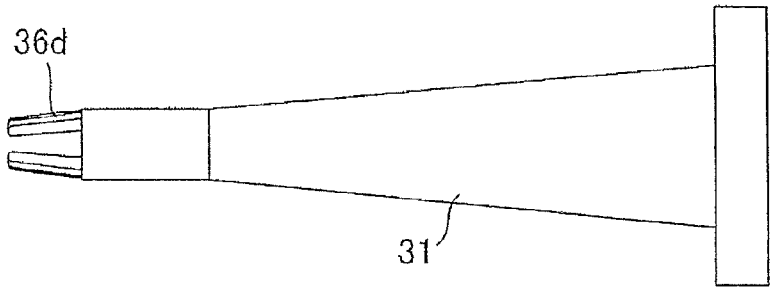
Figure 10C:
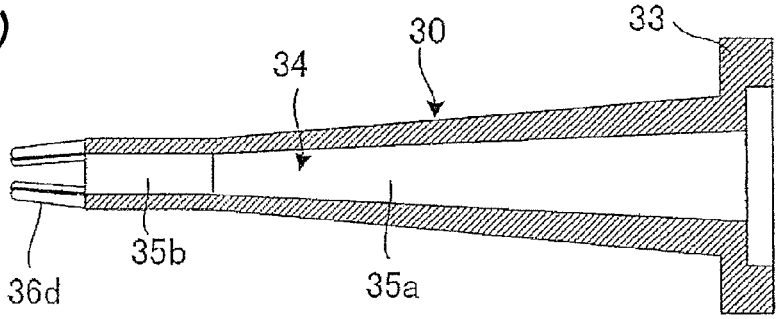
Figure 10D:
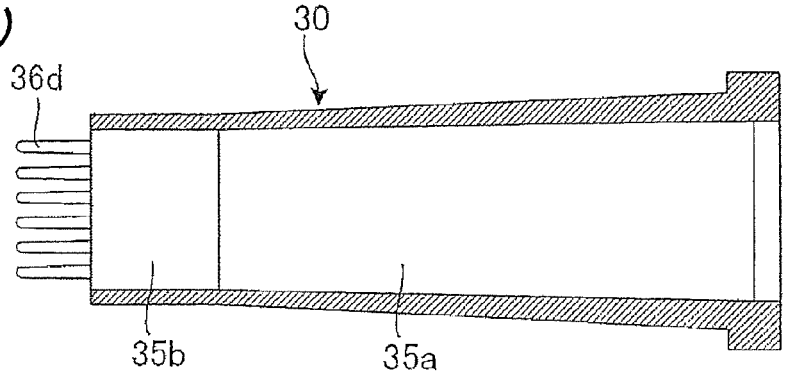

FIGS. 8 and 9 show an applicator part of the fourth embodiment, wherein small-diametric projections of the applicator part are tilted more toward the axial center, forming small-diametric projections 36*c*, compared with the first embodiment.

Figure 11A:
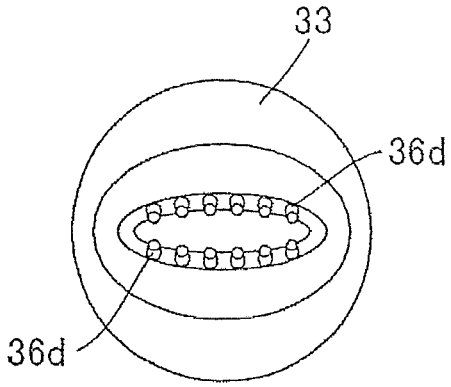
FIG. 11 is an illustrative diagram of the applicator part of FIG. 10, (a) a left side view, (b) a right side view, and (c) a perspective view.
Figure 11B:
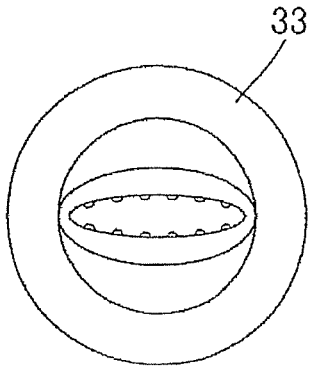
Figure 11C:
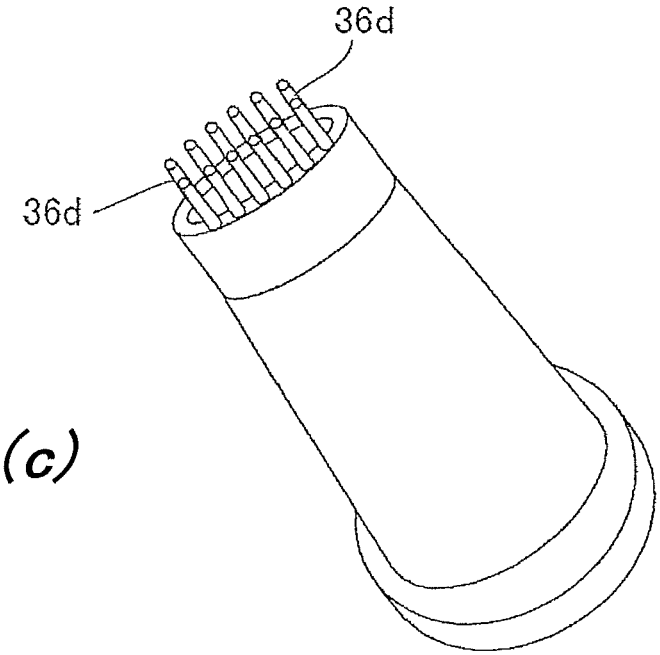
Figure 12A:
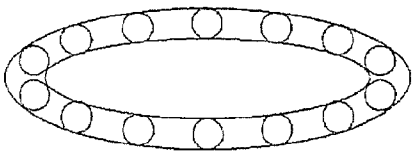
FIG. 12 is an illustrative diagram for explaining other configurations of the delivery port of the applicator part in the applicator according to the present invention, (a) to (f) showing different delivery ports in plan.
Figure 12B:
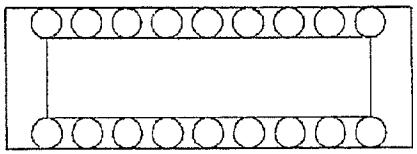
Figure 12C:
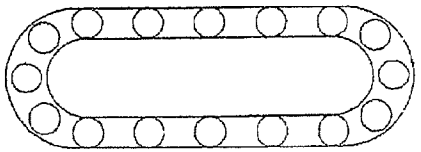
Figure 12D:
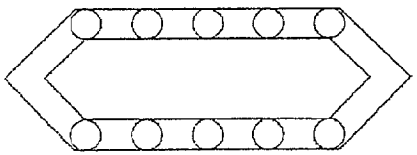
Figure 12E:
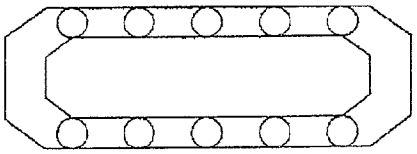
Figure 12F:
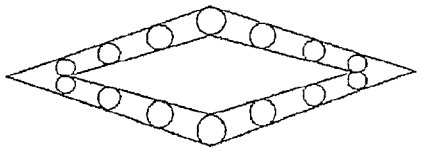
Figure 13A:
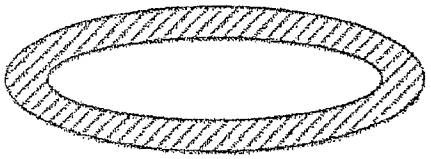
FIG. 13 is an illustrative diagram for explaining other configurations of the delivery port of the applicator part in the applicator according to the present invention, (a) to (f) showing different delivery ports in section.
Figure 13B:
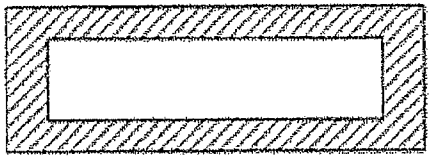
Figure 13C:
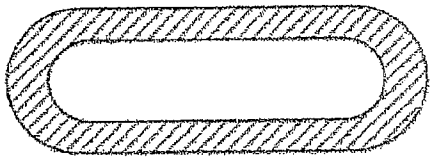
Figure 13D:
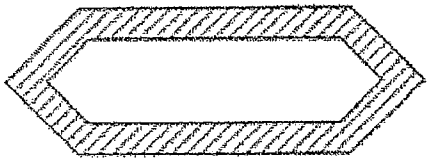
Figure 13E:
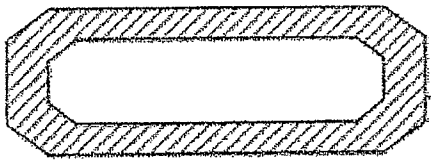
Figure 13F:
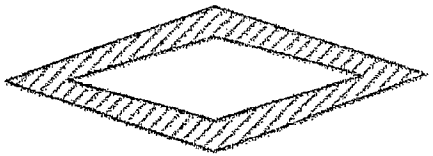

FIGS. 10 and 11 show an applicator part of the fifth embodiment, wherein small-diametric projections of the applicator part are made smaller in diameter, forming small-diametric projections 36*d*, compared with the first embodiment.

Further, in the above embodiments, the opening of delivery port 32 is formed in an oval shape, but the opening may be formed, by listing successively, in a diamond shape, a rectangular shape with its corners beveled, a deformed hexagonal shape, a track shape, a rectangular tail shape, or an oblate elliptic shape, as shown in FIGS. 12(*a*) to (*f*) and FIGS. 13(*a*) to (*f*), with any of small-diametric projections 36, 36*a* to 36*d* of the above embodiments, formed around the opening.

Further, the applicator of the above embodiment has been described taking an example of an applicator for liquid eyeliner and liquid eye shadow. However, the present invention should not be limited to this, and can not only be applied to eyebrow applicators for drawing lines on eyebrows, and for drawing lines on the skin and lips, but also to writing implements capable of drawing fine lines by using ink for writing implements as the application liquid.

Further, as the extruder to be the liquid thrusting mechanism for the liquid applicator of the above embodiment, the applicator of a twist-up dispensing type shown in FIG. 1 is used. However, for example, a knock-type feeding applicator shown in FIG. 14 may be used.

Figure 14A:
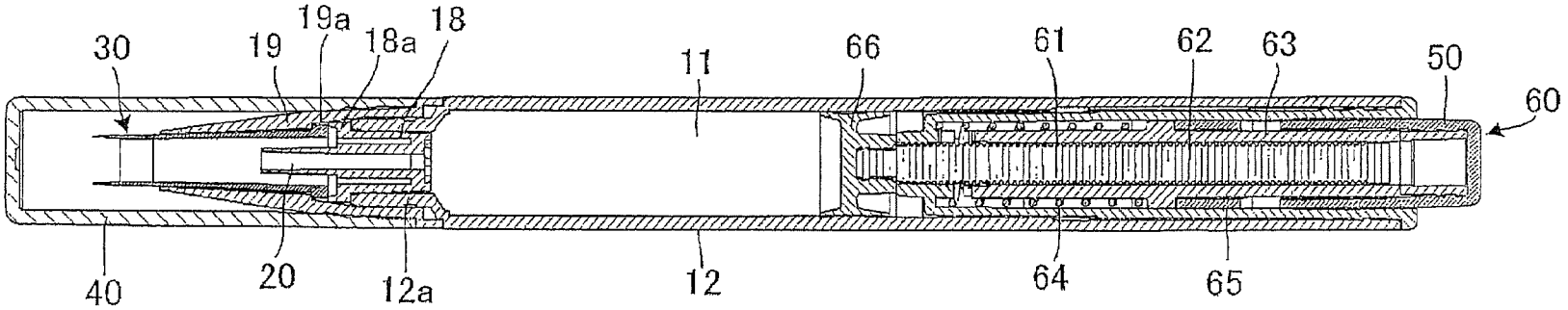
FIG. 14 is an illustrative diagram showing overall sections of an applicator with another embodiment mode of an extruder as a liquid thrusting mechanism of an applicator of the present invention, (a) a plan sectional view and (b) a front sectional view.
Figure 14B:
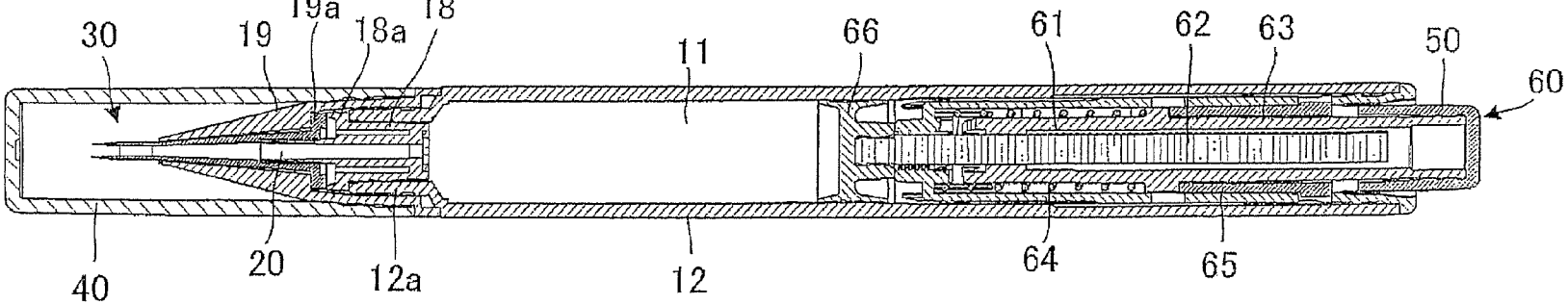

FIG. 14 is an illustrative diagram of the knock-type feeding applicator. Here, in FIG. 4, the same components as in the above first embodiment are allotted with the same reference numerals without description.

The knock-type feeding applicator according to this embodiment can dispense a content liquid in reservoir 11 by pushing a knock member 50 arranged at the rear end of barrel body 12 forwards in the axial direction as shown in FIG. 14, includes: a knocking mechanism unit 60 for converting the pushing force of user's knocking operation on knock member 50 into a rotational force by means of a cam mechanism; and a threaded body 61 fixed to barrel body 12; and a screw rod 62 mated with threaded body 61, and is constructed such that screw rod 62 is rotated by the rotational force converted by the knocking mechanism unit 60 and moved forwards through threaded body 61 to thereby dispense the application liquid. The knocking mechanism unit 60 for converting the pushing force on knock member 50 into rotational force is essentially composed of a rotary part 63 having first and second cam surfaces, threaded body 61 having a first fixed cam surface and a cam body 65 having a second fixed cam surface.

In this knock-type feeding applicator, when knocking is started by pushing knock member 50 in the axial direction, knock member 50 and rotary part 63 integrally move forwards as compressing a spring member 64. As the knocking is further continued, rotary part 63 moves forwards whilst it is rotating in a predetermined direction. During this, since rotary part 63 is rotatably attached to knock member 50, knock member 50 itself does not rotate. With the rotation of rotary part 63 at the time of knocking, screw rod 62 which is restrained from rotating relative to rotary part 63 and freely moves in the axial direction, rotates together with rotary part 63. Screw rod 62 moves forwards together with a piston body 66 by the function of its screw engagement with threaded body 61 to thereby dispense the content liquid in reservoir 11. From this state, the knocking is released. Spring member 64 disposed inside threaded body 61 pushes up rotary body 63 to thereby release the knocking. At this point, rotary body 63 starts rotating in the predetermined rotational direction and moving backwards. As release of the knocking is further continued, the push-up force of spring member 64 also moves rotary body 63 backward whilst it is rotating. Also during this rotation, screw rod 62 is rotated as stated above and moves forwards together with piston body 66 to thereby dispense the application liquid. When this knocking action is repeated, the knocking action and releasing action in the axial direction are converted to rotational force so as to rotate screw rod 62, whereby piston body 66 is pushed forwards so as to be able to dispense a predetermined amount of the content liquid.

EXAMPLES

Next, the present invention will be described in further detail with reference to examples, but the present invention should not be limited to the following examples.

Example 1

An applicator was prepared in conformity with FIG. 1, using an applicator part having the following dimensions, based on the FIGS. 1 to 3 below.

(Configuration of Applicator Part)

Size of the minor axis a: 0.8 mm, the longest direction b: 3.2 mm, the wall thickness around the delivery port: 0.3 mm.

Eight small-diametric projections were formed of 0.3 mm in outside diameter, 1 mm thick and arranged with a pitch of 0.4 mm. The length of the applicator except the small-diametric projections was 13.5 mm. The load applied when the small-diametric projection was flexed 1 mm was 0.01 N. This applicator part was integrally formed of styrene elastomer (trade name: ACTYMER, a product of RIKEN TECHNOS CORP.).

As the content liquid, each of liquid cosmetics shown in composition examples 1-7 in Table 1 on a separate sheet, was charged in an amount of 1.4 ml into the applicator.

TABLE 1

(Total Amount 100 mass %)

| | | Example | | | | | | |
|---|---|---|---|---|---|---|---|---|
| | | 1 | 2 | 3 | 4 | 5 | 6 | 7 |
| Coloring Material (High-brightness Particles) | Polyethylene Terephthalate•Polymethyl Methacrylate Laminate Film Powder *1 | 4 | 0 | 4 | 0 | 4 | 0 | 5 |
| | Titanium Dioxide-coated Scaly Glass *2 | 0 | 4 | 0 | 0 | 0 | 4 | 0 |
| | Indian Red-coated Mica-titanium *3 | 0 | 0 | 0 | 5 | 0 | 0 | 0 |

TABLE 1-continued (Total Amount 100 mass %)

| | | Example | | | | | | |
|---|---|---|---|---|---|---|---|---|
| | | 1 | 2 | 3 | 4 | 5 | 6 | 7 |
| Coating Film Forming Resin | Alkyl Acrylate Copolymer *4 | 4 | 4 | 3 | 8 | 4 | 4 | 4 |
| Anionic Polymer Compound 1 | Methylvinyl Ether/Maleic Acid Crosspolymer *5 | 0.4 | 1 | 1 | 1 | 0 | 0 | 0 |
| Anionic Polymer Compound 2 | Acrylates/C10-30 Alkyl Acrylate Crosspolymer*6 | 0 | 0 | 0 | 0 | 0.5 | 1 | 0 |
| Anionic Polymer Compound 3 | Acrylic Acid/Vinylpyrrolidone Crosspolymer*7 | 0 | 0 | 0 | 0 | 0 | 0 | 1 |
| pH Adjuster | Aminomethyl Propanol | 0.3 | 0.6 | 0.6 | 0.6 | 0.25 | 0.5 | 0.9 |
| Chelating Agent | Disodium Edetate | 0.3 | 0.3 | 0.3 | 0.3 | 0.3 | 0.3 | 0.3 |
| Moisturizing Agent | 1,3-Butylene Glycol | 10 | 10 | 10 | 10 | 10 | 10 | 10 |
| Preservative | Phenoxyethanol | 0.4 | 0.4 | 0.4 | 0.4 | 0.4 | 0.4 | 0.4 |
| Preservative | Methyl Paraben | 0.3 | 0.3 | 0.3 | 0.3 | 0.3 | 0.3 | 0.3 |
| Preservative | Sodium Dehydroacetate | 0.1 | 0.1 | 0.1 | 0.1 | 0.1 | 0.1 | 0.1 |
| Water | Purified Water | Residue | Residue | Residue | Residue | Residue | Residue | Residue |
| Performance Evaulation Results | | | | | | | | |
| Viscosity (mPa · s)*7 | Shear Rate 3.83/$S^{-1}$ | 3588 | 6670 | 7425 | 8480 | 3650 | 3980 | 6248 |
| | Shear Rate 19.2/$S^{-1}$ | 1118 | 1860 | 1900 | 2170 | 1134 | 1450 | 1742 |
| | Shear Rate 38.3/$S^{-1}$ | 641 | 1072 | 913 | 1043 | 649 | 949 | 1004 |
| | Shear Rate 76.8/$S^{-1}$ | 289 | 664 | 598 | 683 | 294 | 621 | 622 |

*1: Particle Size 200 μm
*2: Particle Size 150 μm
*3: Particle Size 70 μm
*4: Alkyl Acrylate Copolymer • • • Luvimer 100P (a product of BASF Co.,)
*5: Methylvinyl Ether/Maleic Acid Crosspolymer • • • STABILEZE (product of ISP Ltd.)
*6Acrylates/C10-30 Alkyl Acrylate Crosspolymer • • • Carbopol (product of B F Goodrich Co.)
*7Acrylic Acid/Vinylpyrrolidone Crosspolymer • • • Ultra Thix P-100 (product of ISP Ltd.)
*8: Viscosity Measurement Condition: EMD type Viscometer (product of TOKI SANGYO CO., LTD. Starndard Corn Rotor: 20 rpm at a shear rate of 76.8(S−1)

Each of the thus prepared applicators was used so as to push out the liquid cosmetic as the content liquid by a dispensing operation. The liquid cosmetic (each of composition examples 1-7) was delivered from the groove and retained between small-diametric projections by capillary force. When tip of the applicator was applied to the contour of the eye, or the application target surface, the small-diametric projections arranged on the delivery port could draw fine lines by application in the minor axis direction and thick lines by application in the major axis direction even when a cosmetic including large-sized particles was used as the content liquid. Thus, it was found that applicators could satisfy the user.

Further, since suitable rigidity for makeup actions could be obtained and small-diametric projections laid out on the delivery port had suitable flexibility so that the user could draw lines with an application force suitable for contact to the skin without feeling pain.

INDUSTRIAL APPLICABILITY

The present invention can be preferably used as applicators for liquid eyeliner, liquid eye shadow and others.

DESCRIPTION OF REFERENCE NUMERALS

10 extruder (liquid thrusting mechanism)
11 reservoir
12 barrel body
12*a* front end part
13 advancing member
13*a* crown
13*b* spring member
14 screw rod
15 drive sleeve
16 threaded part
17 piston body,
18 joint member
18*a* front end part
19 front barrel
19*a* rear step
20 flow passage
30 applicator part
31 applicator part body
32 delivery port
33 flange part
34 liquid pass
35*a* tapering pass
35*b* tubular pass
36 small-diametric projection
36*a* small-diametric projection
36*b* small-diametric projection
36*c* small-diametric projection
36*d* small-diametric projection
40 cap
50 knock member
60 knocking mechanism unit
61 threaded body
62 screw rod
63 rotary part
64 spring member
65 cam part
66 piston body

The invention claimed is:

1. An applicator comprising:

an applicator part having a mechanism for delivering or applying a content liquid;

a reservoir filled with the content liquid; and an extruder having a mechanism of pushing out the content liquid to the applicator part, and wherein a flow passage that connects between the applicator part and the reservoir is formed, thereby pushing out the content liquid inside the reservoir, and the content liquid passes through the flow passage communicating between the applicator part and the reservoir, thereby being ejected out from the applicator part, and wherein the shape of the content liquid delivery port of the applicator part is oval or rectangular, and the minor axis and major axis on the delivery port side are specified to be 0.5 to 2 mm and 2 to 8 mm, respectively, and the content liquid is a liquid cosmetic that has a viscosity (25 deg. C.) at a shear rate of 7.68 $S^{-1}$ in an EMD type viscometer, falling within the range of 250 to 1,000 mPa·s.

2. The applicator according to claim 1, wherein a plurality of small-diametric projections are formed on the delivery port side of the applicator part, being 0.1 to 1 mm in outside diameter and 0.5 to 3 mm long with a pitch of 0.1 to 1.5 mm.

3. The applicator according to claim 2, wherein the tip of the small-diametric projection arranged on the delivery port side of the applicator part flexes 1 mm when a force of 0.001 to 0.5 N is applied in a direction at right angles thereto.

4. The applicator according to claim 3, wherein the applicator part has a flange part on a rear side of the applicator part, The flange part is fitted into a front barrel, and the applicator part is comprised of rubber or elastomer.

5. The applicator according to claim 1, wherein the applicator part has a flange part on a rear side of the applicator part, the flange part is fitted into a front barrel, and the applicator part is comprised of rubber or elastomer.

6. The applicator according to claim 2, wherein the applicator part has a flange part on a rear side of the applicator part, the flange part is fitted into a front barrel, and the applicator part is comprised of rubber or elastomer.

* * * * *